US012546558B2

(12) United States Patent
Steele et al.

(10) Patent No.: US 12,546,558 B2
(45) Date of Patent: Feb. 10, 2026

(54) ADJUSTABLE FINGER SUPPORT FOR ARCHERY RELEASE

(71) Applicant: Gregory E. Summers Trust Agreement dated December 8, 2006, Madison Heights, VA (US)

(72) Inventors: Brent Steele, Lynchburg, VA (US); Tristan Mason, Madison Heights, VA (US); Gregory E. Summers, Amherst, VA (US)

(73) Assignee: Veritas 2, LLC, Madison Heights, VA (US)

( * ) Notice: Subject to any disclaimer, the term of this patent is extended or adjusted under 35 U.S.C. 154(b) by 162 days.

(21) Appl. No.: 18/423,494

(22) Filed: Jan. 26, 2024

(65) Prior Publication Data

US 2025/0244101 A1 Jul. 31, 2025

(51) Int. Cl.
*F41B 5/14* (2006.01)
*F41B 5/18* (2006.01)

(52) U.S. Cl.
CPC ..... *F41B 5/1473* (2013.01); *F41B 5/1469* (2013.01)

(58) Field of Classification Search
CPC ..... F41B 5/1473; F41B 5/1469; F41B 5/148; F41B 5/1442
USPC ..... 124/86
See application file for complete search history.

(56) References Cited

U.S. PATENT DOCUMENTS

| | | | | |
|---|---|---|---|---|
| 9,618,295 | B1 * | 4/2017 | Rentz | F41B 5/1469 |
| 9,982,961 | B1 * | 5/2018 | Rentz | F41B 5/1469 |
| 10,830,554 | B1 * | 11/2020 | Jones | F41B 5/1469 |
| 2008/0149084 | A1 * | 6/2008 | Whalen | F41B 5/1469 124/35.2 |
| 2016/0282079 | A1 * | 9/2016 | Rentz | F41B 5/1469 |
| 2020/0326149 | A1 * | 10/2020 | Springer | F41B 5/1469 |

* cited by examiner

*Primary Examiner* — John E Simms, Jr.
(74) *Attorney, Agent, or Firm* — Leading Edge Law Group, PLC

(57) ABSTRACT

An adjustable finger support for an archery release includes a handle having a longitudinal axis, top and bottom portions and interior and exterior side surfaces. A pair of finger beds are configured for pivotal connection with the handle. A drive assembly connects the finger beds with the handle and displaces the finger beds relative to the handle to a desired width. The drive assembly includes a pair of brackets pivotally connected with the handle. The angle of the finger beds is further adjustable relative to the brackets, so that the finger beds are adjustable in both width and to provide variable finger support and an optimal fit for the archer to better positions a head portion of the archery release toward a target.

11 Claims, 16 Drawing Sheets

ADJUSTABLE FINGER SUPPORT FOR ARCHERY RELEASE

BACKGROUND OF THE INVENTION

Release devices are used in archery to assist the archer in pulling a bowstring to a fully drawn position and then releasing the bowstring to fire an arrow. Some release devices use grippers for engaging a bowstring or a nock mounted on the bowstring. Other release devices use a rope looped around the bowstring. Also common are handheld releases which generally one of two types, using either a trigger or back tension to fire the shot.

The present invention relates to an archery release, and more particularly to a handheld archery release which includes adjustable finger beds.

BRIEF DESCRIPTION OF THE PRIOR ART

Virtually all handheld archery releases include a handle which is configured for gripping by the archer. Usually, the handle is gripped by the index and middle fingers of the archer, with the fingers being supported by contoured finger beds in an upper surface of the handle. It is known in the art to provide a handheld archery release with radially adjustable finger pieces as disclosed in U.S. Pat. No. 9,618,295. However, the side portions of the release handle are generally fixed which inhibits repeatable finger bed placement by the archer which limits accuracy of a shot. The present invention was developed in order to overcome the drawbacks of existing handheld releases by providing finger beds at the side walls of an archery release handle which are adjustable in both width and angle. Such adjustability allows the head of the release to be pointed toward a target from an axis that is perpendicular to the radial finger adjustability of prior handheld archery releases.

SUMMARY OF THE INVENTION

Accordingly, it is a primary object of the invention to provide improved finger support for a handle of an archery release. The handle is formed of mating handle portions which define a cavity within the handle. The handle has a longitudinal axis and top and bottom portions and exterior side surfaces. A pair of finger beds are pivotally connected with the sides of the handle via a drive assembly. More particularly, the drive assembly connects the finger beds with the handle and displaces the handle relative to the handle to a desired width to support a finger of a portion of an archer for operation of the release. Thus, the angle of the finger bed relative to the handle portion can be adjusted as desired by the archer for an optimal fit and to better position a head portion of the archery release toward a target.

The drive assembly includes a pair of brackets pivotally connected at one end with the handle via a dowel pin arranged along the longitudinal axis of the handle. Each finger bed is pivotally connected at its upper end with a lower end of a respective bracket. The drive assembly further includes a toggle clamp arranged within the handle cavity. The toggle clamp contains an elongated opening for receiving the dowel pin. A width adjustment screw is also provided. It passes through an opening in the bottom of the handle and is threadably connected with a lower portion of the toggle clamp so that operation of the width adjustment screw displaces the toggle clamp within the handle in a direction normal to the longitudinal axis. The brackets are arranged on opposite sides of the handle and contain a tapered recess in an interior surface thereof. Opposed upper end portions of the toggle clamp extend into the recesses of the brackets. Accordingly, the toggle clamp slides within the bracket tapered recess during operation of the width adjustment screw to pivot the brackets about the dowel pin and adjust the width of the finger bed relative to the handle.

A locking mechanism is provided to lock the brackets in a selected width position relative to the handle. The locking mechanism includes a pair of additional dowel pins between the respective brackets and the handle, and a pair of set screws arranged on opposite sides of the width adjustment screw to engage a respective additional dowel pin.

Each finger bed includes a projection extending from a lower end toward the bracket with which it is connected and the bracket contains an opening to receive the finger bed projection. A set screw is connected with the bracket and configured to engage the projection to lock the finger bed in selected angular position relative to the handle.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
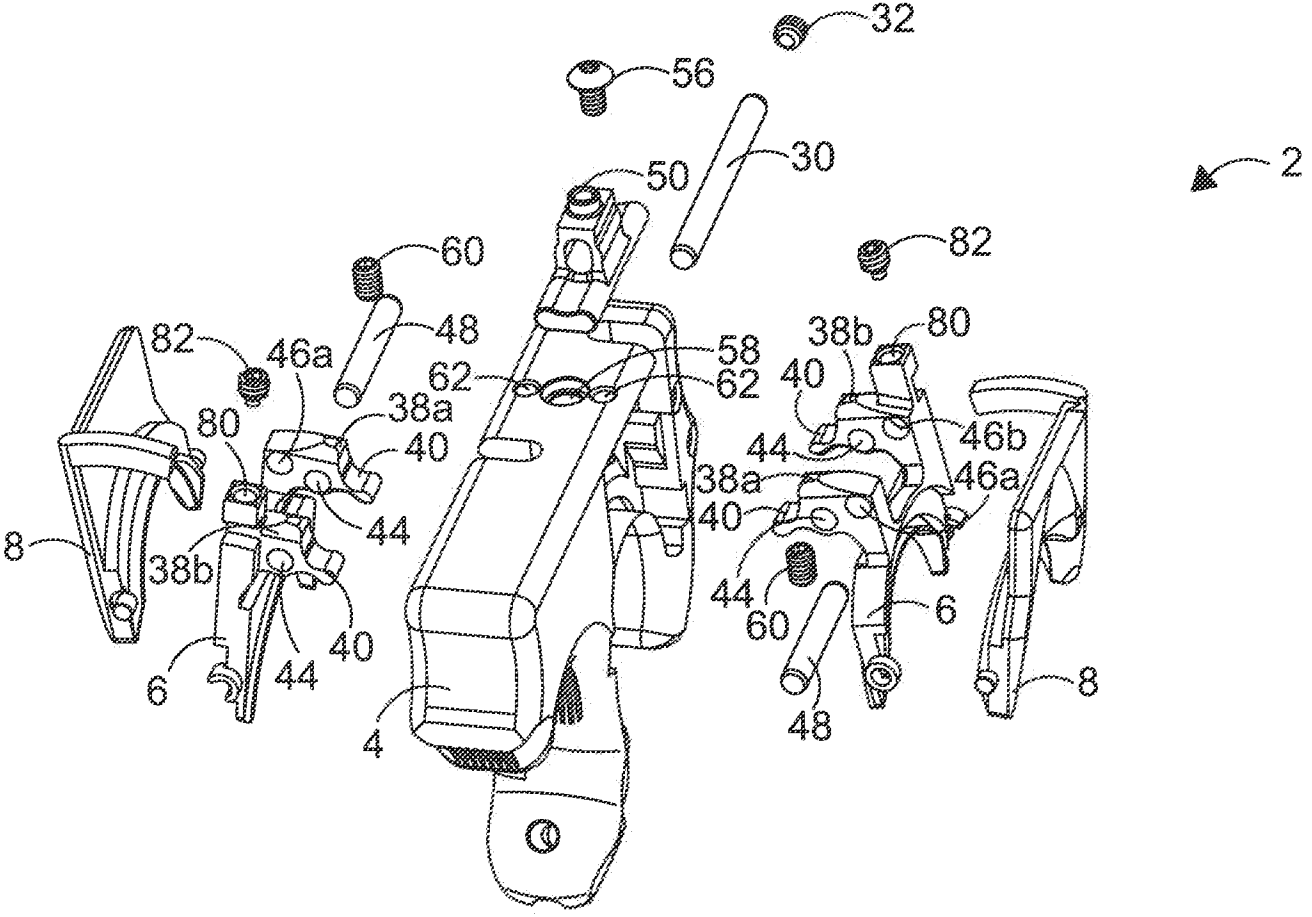
FIG. 1 is an exploded bottom perspective view of an adjustable finger bed archery release according a first embodiment of the invention.
Figure 2A:
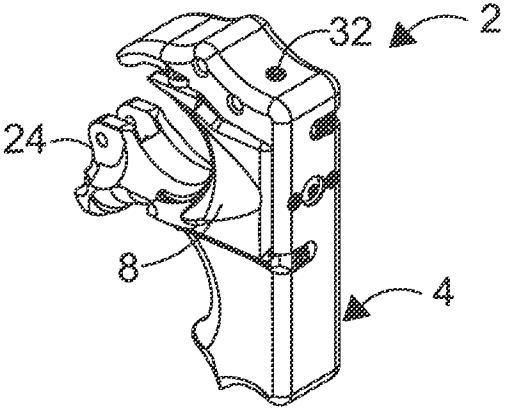
FIGS. 2*a*, 2*b*, 2*c*, 2*d*, 2*e*, 2*f*, 2*g*, 2*h* and 2*i* are bottom front right perspective, bottom rear right perspective, bottom front left perspective, bottom rear left perspective, front, rear, left side, right side, and bottom views, respectively, of the archery release of FIG. 1.
Figure 2B:
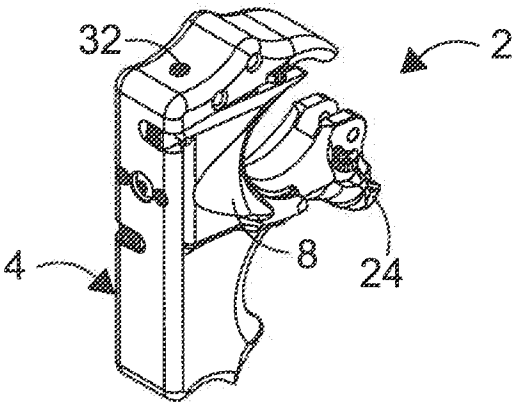
Figure 2C:
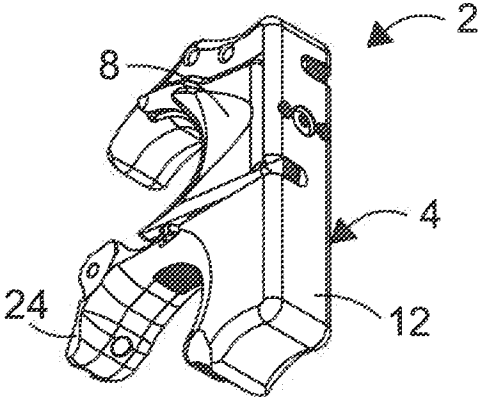
Figure 2D:
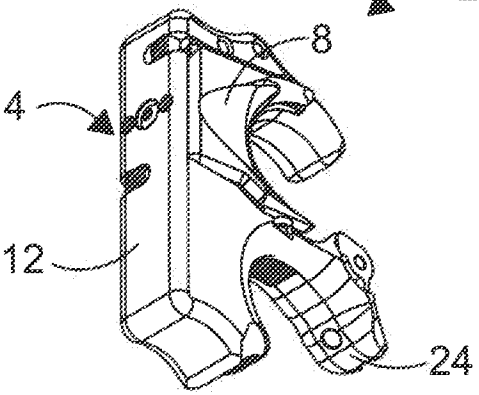
Figure 2E:
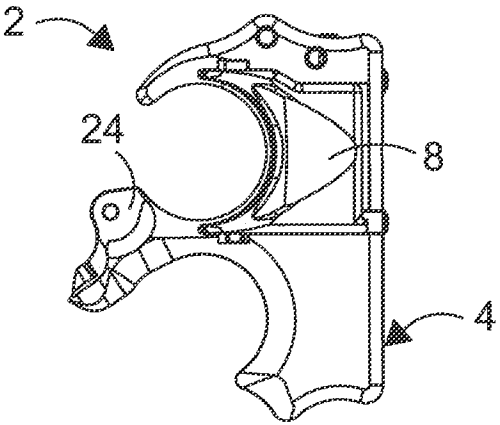
Figure 2H:
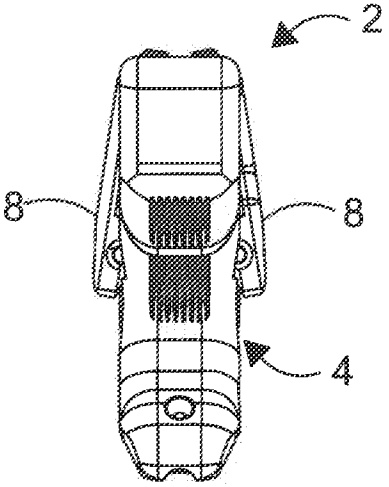
Figure 2G:
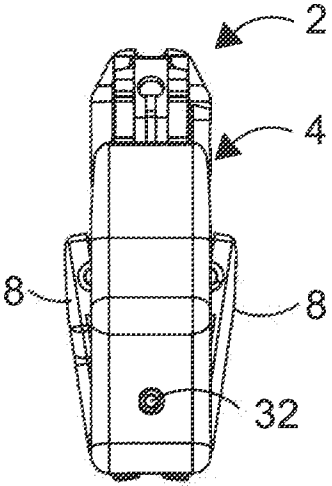
Figure 2I:
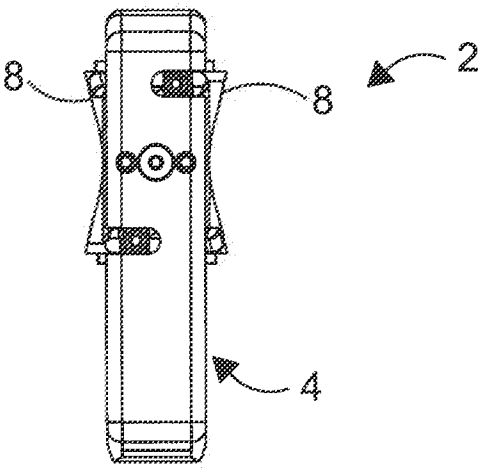
Figure 2F:
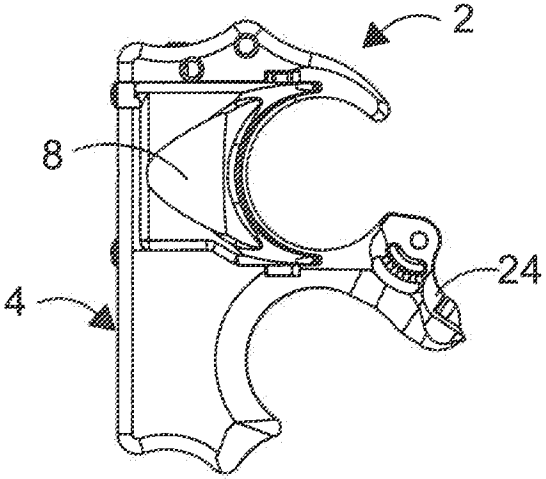
Figure 3C:
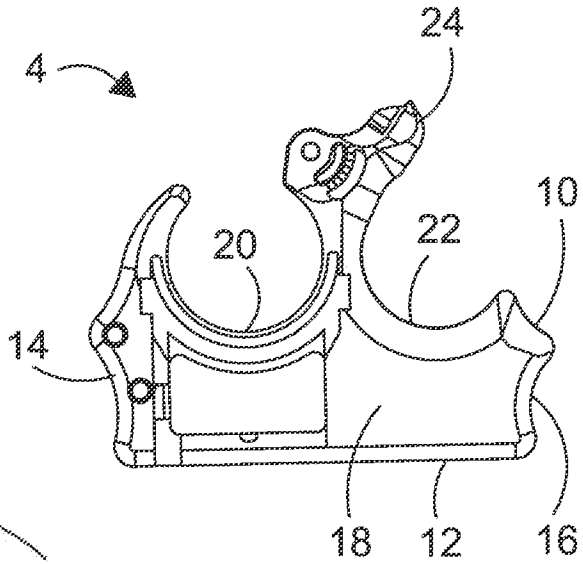
FIGS. 3*a*, 3*b*, 3*c*, 3*d*, 3*e*, and 3*f* are front right perspective, front left perspective, front, rear, top, and bottom views, respectively, of a handle of the archery release of FIG. 1.
Figure 3B:
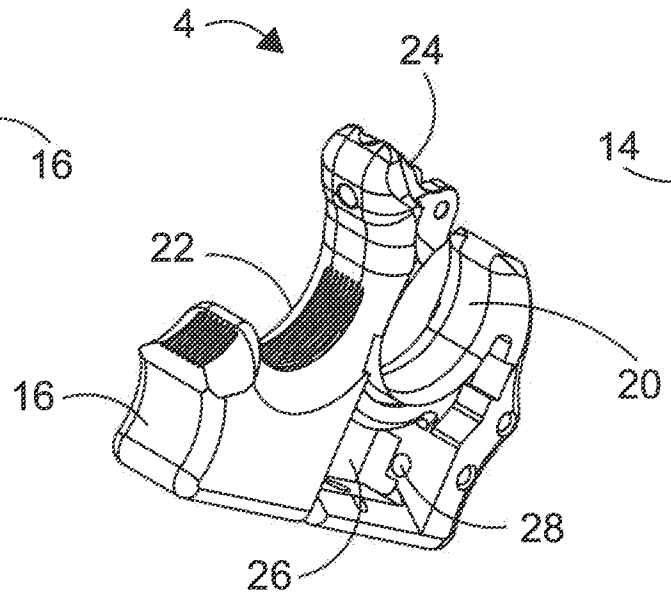
Figure 3A:
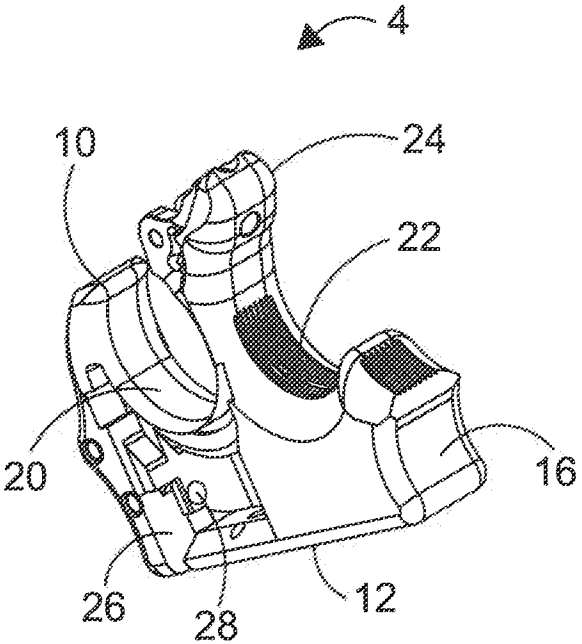
Figure 3F:
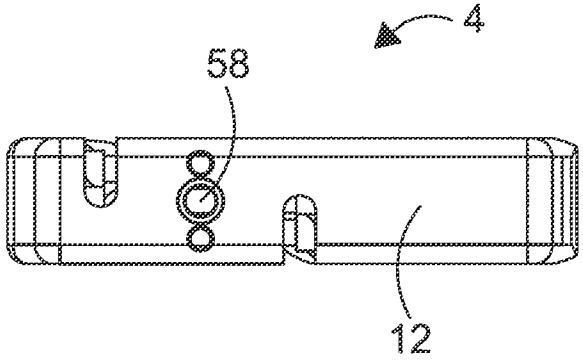
Figure 3E:
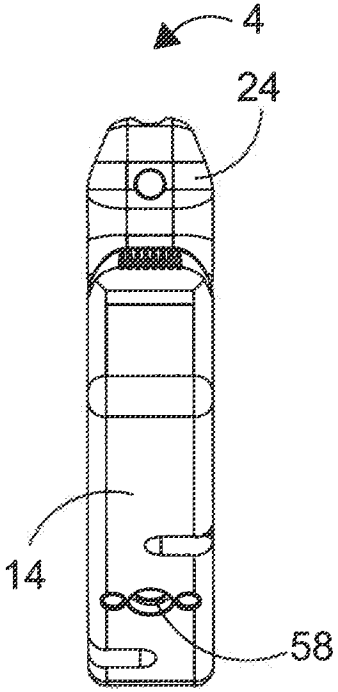
Figure 3D:
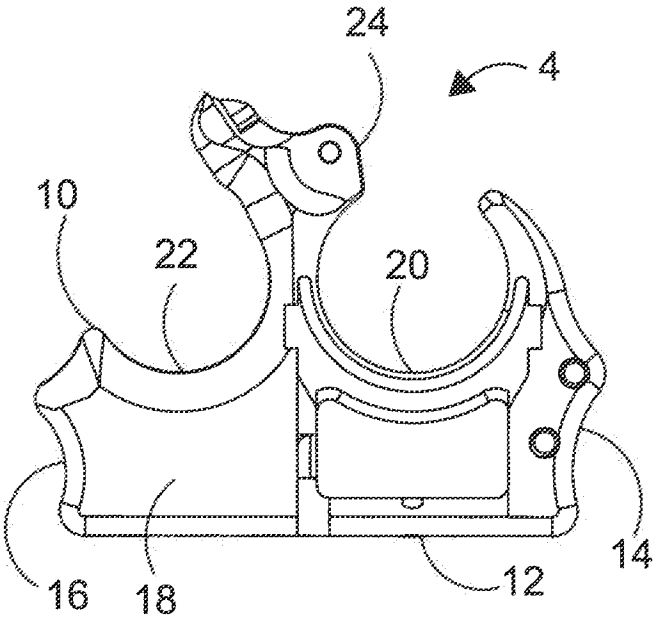

A preferred embodiment of a handheld archery release 2 having an angularly adjustable finger bed according to the invention is shown in FIGS. 1 and 2. The release includes a handle 4 which preferably is formed of two concave handle portions or sections. The release also includes a pair of brackets 6 pivotally connected with the handle and a pair of finger beds 8 pivotally connected with the brackets. Together, the brackets and finger beds provide width and angular adjustment to the finger support portion of the release. The assembled archery release is shown in FIGS. 2*a*-2*i*.

The handle of the release is shown in FIGS. 3*a*-3*f*. As shown therein, the handle has a longitudinal axis and includes top 10, bottom 12, front 14 and rear 16 portions and side 18 surfaces. The top portion 10 of the handle contains front 20 and rear 22 spaced contours having a concave configuration, each of the contours supporting a finger of an archer when the archery release is in use. Preferably, the front contour supports the index finger of the archer and the rear contour supports the middle finger of the archer. Between the front and rear contours is a head 24 on which a bail (not shown) is mounted to hold and release a bowstring. The handle is preferably formed of two mating halves which define a cavity therein and are joined with screws or other fasteners as is known in the art. A sear, not shown, is arranged within the handle cavity and is operable to release the bail when the release is operated to fire a shot.

Each side of the handle contains recess 26 below the front contour 20 for receiving a portion of a bracket. The handle further contains an opening 28 in the front wall 14 configured to receive a dowel pin 30 which is retained in the opening via a plug screw 32. The dowel pin and plug screw are shown in FIG. 1.

Figure 4C:
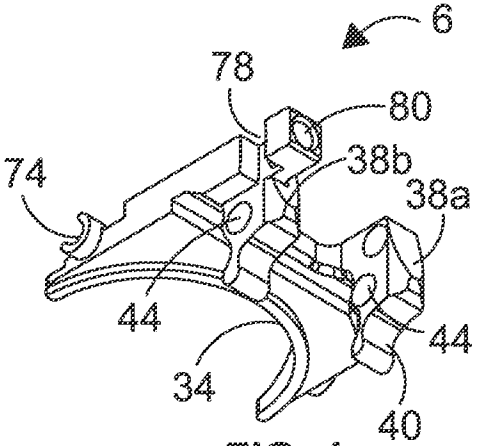
FIGS. 4*a*, 4*b*, 4*c*, 4*d*, 4*e*, 4*f*, 4*g*, 4*h*, and 4*i* are top front left perspective, top front right perspective, bottom front left perspective, bottom front right perspective, front, rear, top, bottom and right side views, respectively, of a bracket of the archery release of FIG. 1.
Figure 4E:
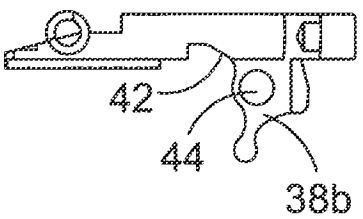
Figure 4B:
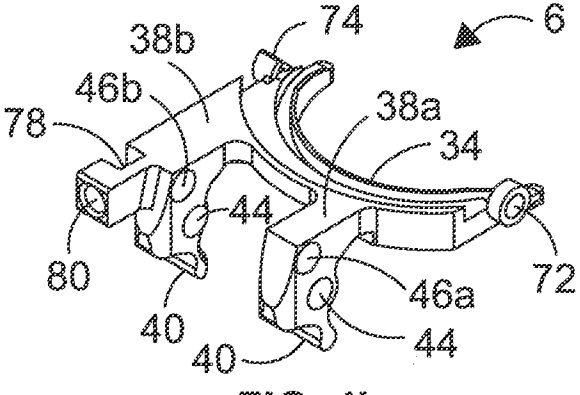
Figure 4D:
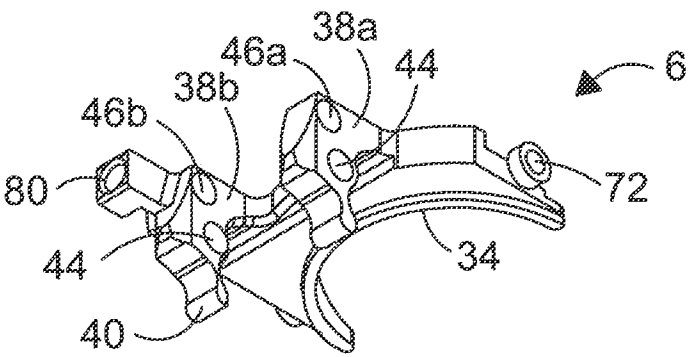
Figure 4A:
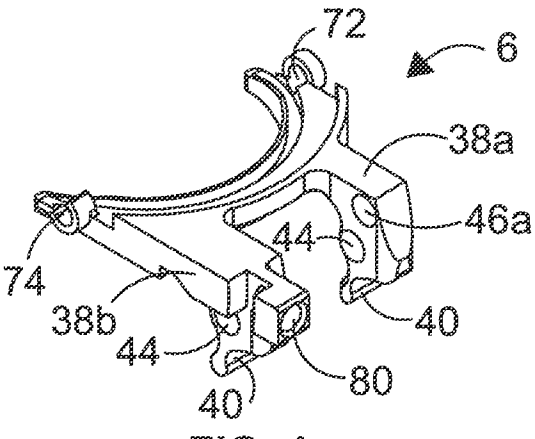
Figure 4H:
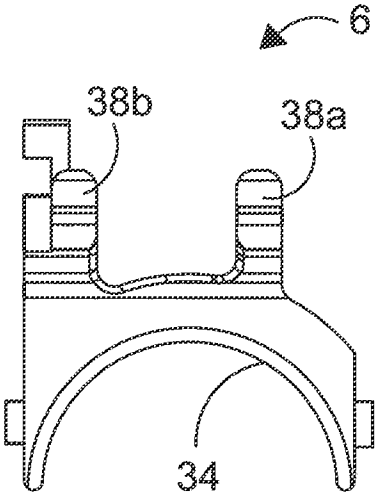
Figure 4G:
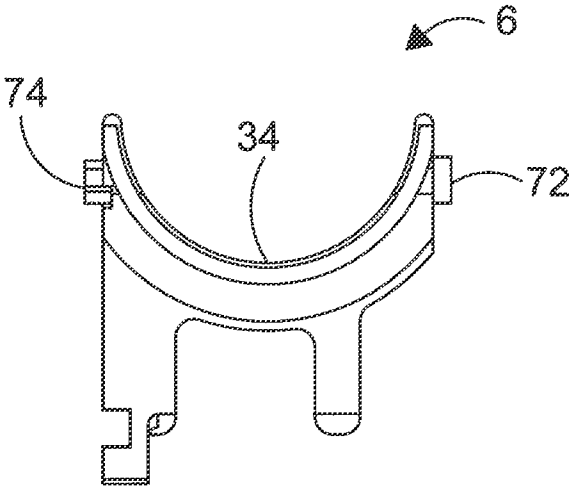
Figure 4I:
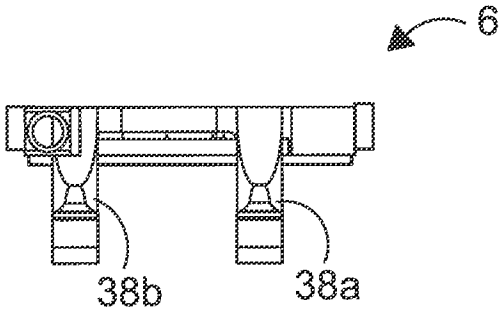
Figure 4F:
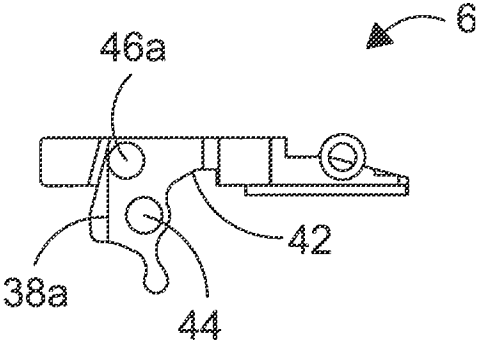
Figure 5C:
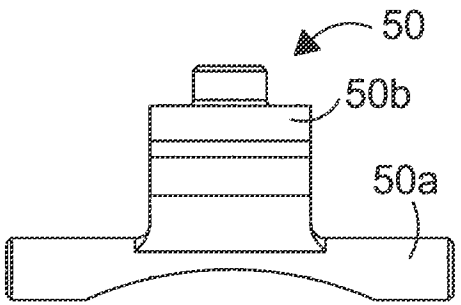
FIGS. 5*a*, 5*b*, 5*c*, 5*d*, 5*e*, 5*f*, and 5*g* are bottom front perspective, bottom rear perspective, front, left side, right side, bottom and top views, respectively, of a toggle clamp for the archery release of FIG. 1.
Figure 5B:
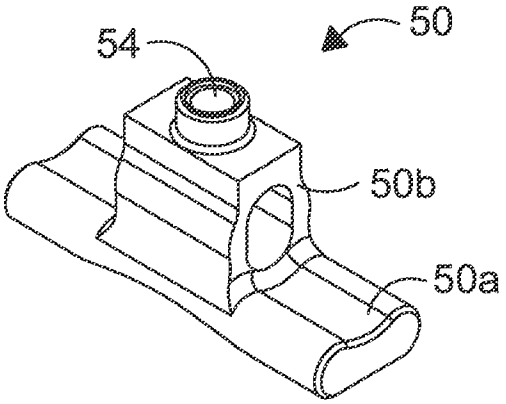
Figure 5A:
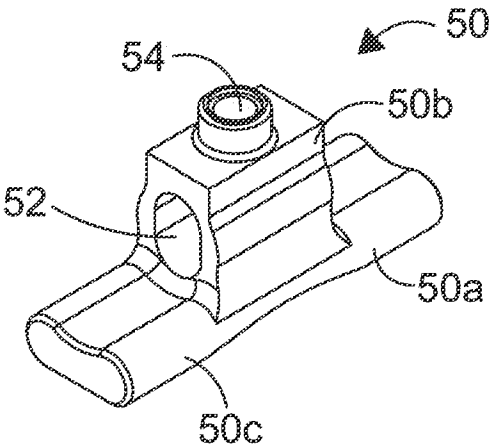
Figure 5E:
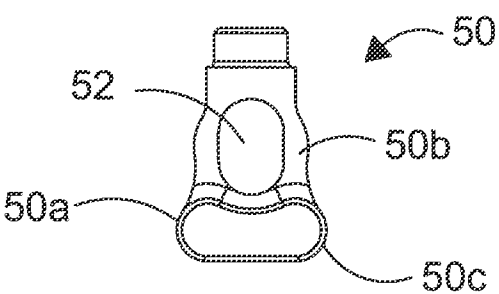
Figure 5D:
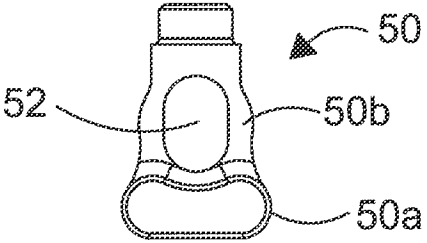
Figure 5G:
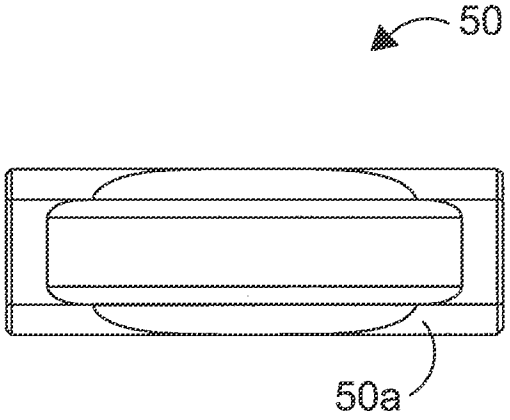
Figure 5F:
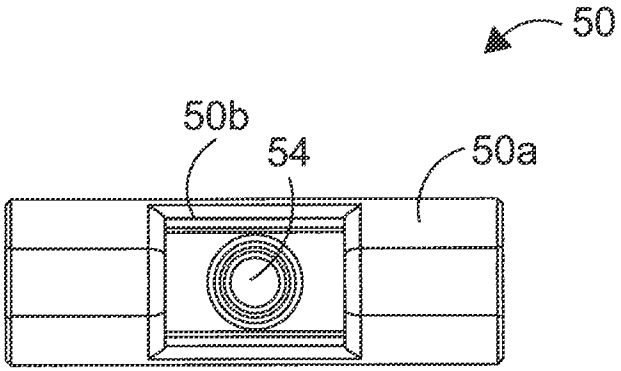
Figure 7:
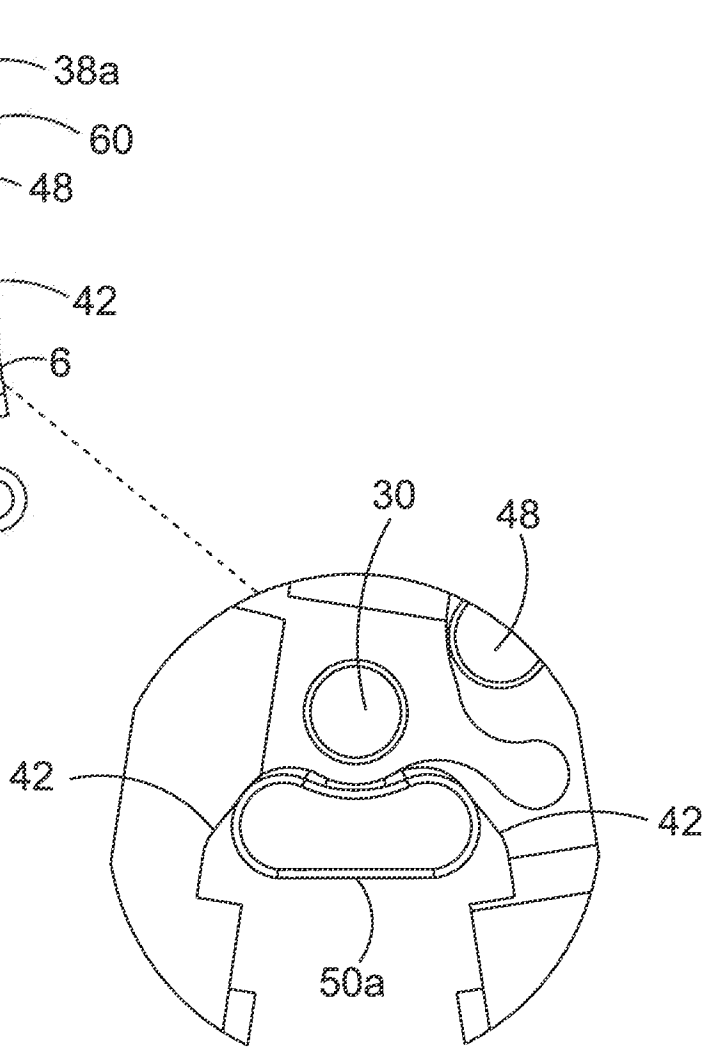
FIG. 7 is a detailed partial sectional view taken along line 7-7 of FIG. 6*b;*

The brackets 6 for connecting the finger beds 8 with the handle 4 have the same configuration. One of the brackets is shown in detail in FIGS. 4*a*-4*i*. The bracket has a generally U-shaped configuration to define a contour 34 which matches the front contour 20 of the handle. The bottom of the bracket includes a spaced pair of projections 38*a*, 38*b* which terminate in laterally extending supports 40. The bottom of each bracket is arranged in the recess 26 in the bottom area of a side of the handle. Each bracket projection has an inner surface which faces the handle and an outer surface. The inner surface contains a tapered recess 42 as shown in FIGS. 4*e* and 4*f*. Each bracket projection further contains aligned openings 44 configured to receive the dowel pin 30 about which the brackets may pivot relative to the handle. The bracket projections 38*a*, 38*b* further contain second openings 46*a*, 46*b*, respectively. However, the second opening 46*a* in projection 38*a* is a through opening while the second opening 46*b* in the projection 38*b* is a partial opening. These openings 46*a*, 46*b* are also aligned and are configured to receive a dowel pin 48 as shown more particularly in FIGS. 1, 6*a* and 6*b*.

The brackets 6 form part of a drive assembly for moving the finger beds 8 relative to the handle 4 in order to adjust the width of the effective finger beds. Another part of the drive assembly is a toggle clamp 50 which is arranged within the handle recesses.

The toggle clamp is shown in detail in FIGS. 5*a*-5*g*. It includes upper 50*a* and lower portions 50*b* and is configured to fit within a bottom portion of the handle cavity between bottom portions of the brackets 6 as shown more particularly in FIGS. 6*a* and 6*b*. The upper portion 50*a* extends beyond the bottom portion 50*b* in the longitudinal direction. The upper portion preferably includes curved or convex side edges 50*c* as will be explained in greater detail below. The lower portion 50*b* contains a longitudinal through opening 52 and a threaded opening 54 in the bottom surface of which extends normal to the longitudinal direction of the through opening. The through opening 52 preferably has an oval configuration. It is configured to receive the dowel pin 30 when it is arranged in the handle cavity. Owing to the oval configuration of the opening 52, the toggle clamp is displaceable within the handle cavity relative to the dowel pin. A width adjustment screw 56 is threadably connected with the toggle clamp via the threaded opening 54.

Figure 6B:
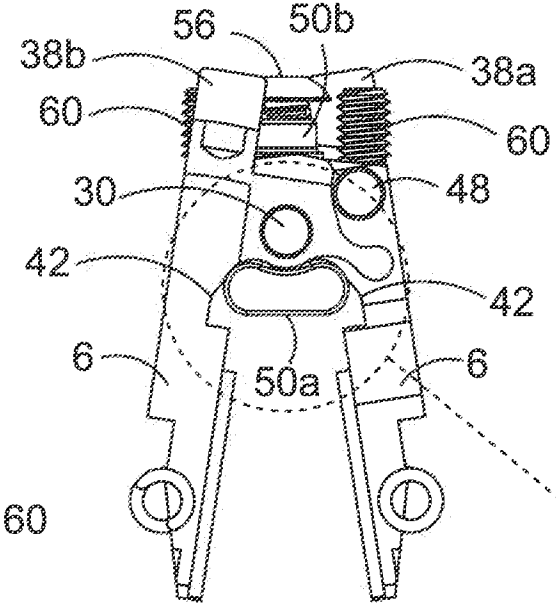
FIGS. 6*a* and 6*b* are front left perspective and left plan views, respectively, of the drive assembly for the archery release of FIG. 1.
Figure 6A:
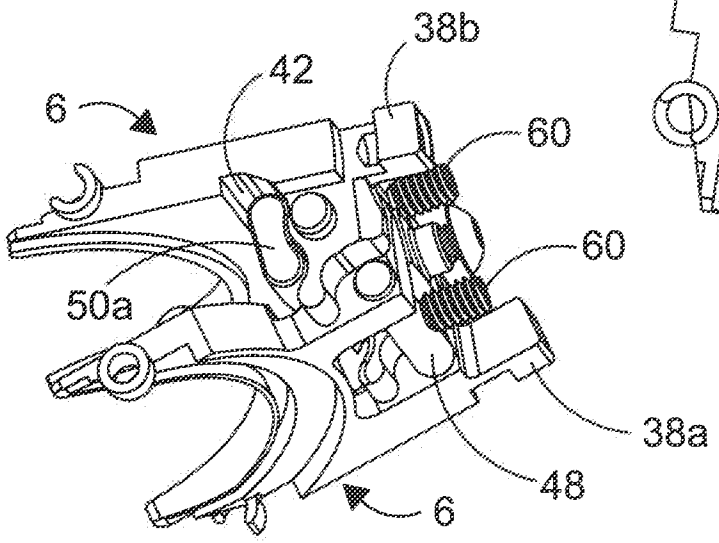
Figure 8C:
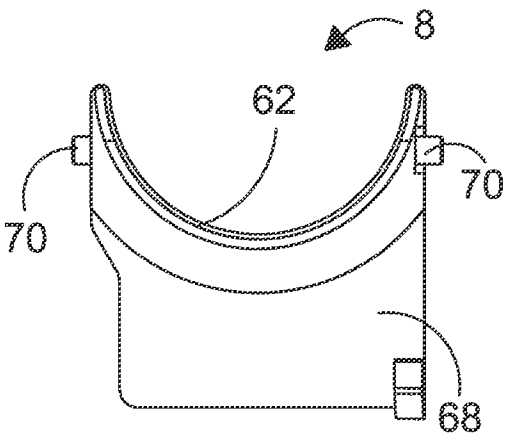
FIGS. 8*a*, 8*b*, 8*c*, 8*d*, 8*e*, 8*f*, and 8*g* are bottom front perspective, front, rear, left side, right side, top, and bottom views, respectively, of the finger bed of FIG. 4.
Figure 8B:
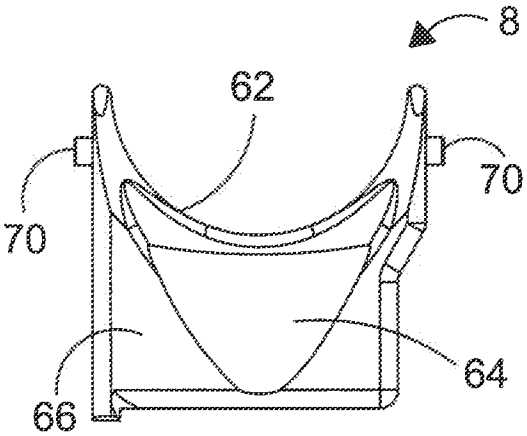
Figure 8A:
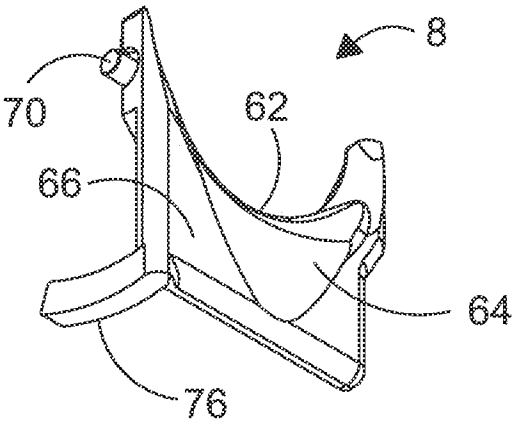
Figure 8E:
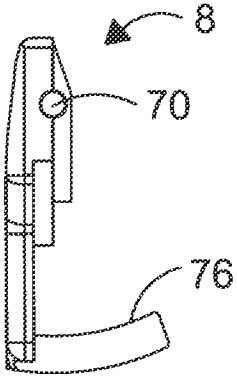
Figure 8D:
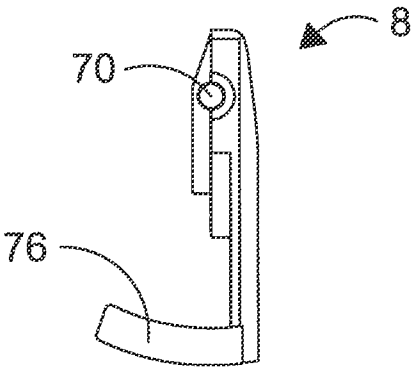
Figure 8G:
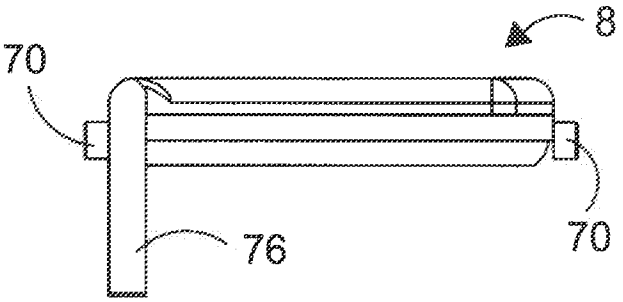
Figure 8F:
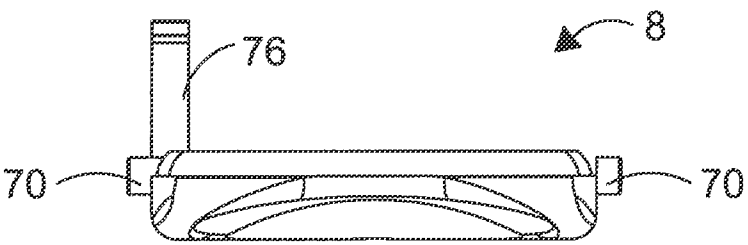

The bottom portion 12 of the handle 4 contains a through opening 58 through which the width adjustment screw 56 passes for connection with the toggle clamp lower portion threaded opening 54 as shown in FIGS. 1, 6*a* and 6*b*. Rotation of the width adjustment screw displaces the toggle clamp within the handle in a direction normal to the longitudinal axis. In this regard, the curved edges 50*c* of the toggle clamp upper portion 50*a* slide within the recesses 42 in the inner surface of each bracket 6. As the width adjustment screw 56 is tightened, the toggle clamp moves toward the bottom of the handle and slides within the bracket recesses to pivot the brackets about the dowel pin and extend the upper portions of the brackets from the handle to an extended wider position. Conversely, as the width adjustment screw 56 is loosened, the toggle clamp moves toward the top of the handle, sliding within the bracket recesses to pivot the brackets about the dowel pin and retract the upper portions of the brackets toward from the handle to a retracted narrow position.

Set screws 60 pass through openings in the handle bottom surface on opposite sides of the opening 58 to engage the respective dowel pins 48 as shown in FIGS. 1, 6*a*, and 6*b*. The set screws must be loosened before width adjustment of the brackets is made. The set screws are then locked down by putting pressure onto the dowel pins 48 located in the brackets which in turn pushes pressure between the radii located on the toggle clamp and the bracket angular surfaces within the recesses 42 resulting in opposing pressure between the width adjustment screw 56 and the lock down set screws 60 to keep the width adjustment in place. That is, the set screws 60 must be tightened in order for the angular surfaces of the brackets to maintain contact with the underside radii of the width toggle clamp. The two set screws are integral to affixing the width since there is no spring maintaining contact of the toggle clamp underside radii with the angular surface of the brackets. The set screws define the opposing force of the width adjustment screw to lock the width adjustment of the brackets in place.

As noted above, finger beds 8 are pivotally connected with the brackets 6. The finger beds are shown in detail in FIGS. 8*a*-8*h*. Each finger bed has a generally rectangular configuration with a concave upper surface 62 corresponding with the front contour 20 of the handle portion. That is, the concave surfaces of the finger bed and the front contour of the handle portion are aligned. The front surface of the finger bed contains a tapered recess 64 extending from the concave upper surface toward the bottom portion of the finger bed. Preferably, the tapered recess terminates short of the bottom portion. The depth of the tapered recess decreases from the top portion to the bottom portion and the longitudinal length of each tapered recess also decreases in the direction of the bottom portion. Preferably, the length of the upper portion of each tapered recess extends a longitudinal length equal to the longitudinal length of the front contour of the handle portion. The tapered recess thus has a scalloped configuration.

Each finger bed further includes front 66 and rear 68 surfaces. At the top portion of these surfaces, a pair of nubs or stubs 70 extend along a finger bed axis parallel to the longitudinal axis of the handle. The stubs are configured to fit within fittings in the top portion of the brackets. More particularly, one side at the top of the bracket contains a through hole 72 and the other side of the top of the bracket contains a contour 74. One stub of the finger bed is arranged in the through hole and the other stub of the finger bed is arranged in the contour, preferably via a snap-fit connection so that the finger beds swing freely within the bracket opening and contour so that the finger bed pivots about an axis parallel to the longitudinal axis. As such, the top portion of each finger bed is pivotally connected with the top portion of the corresponding bracket while the bottom portion of each finger bed moves toward or away from the handle portion.

Each finger bed 8 further includes a projection 76 which extends rearwardly from a bottom portion thereof toward the bracket with which the finger bed is connected. Each bracket projection 38*b* contains a slot 78 to receive the projection. The projection extends freely through the slot during pivotal movement of the finger bed relative to the associated bracket. However, a locking mechanism is provided to lock the finger bed in a selected angular orientation relative to the bracket as selected by the archer.

Figure 10:
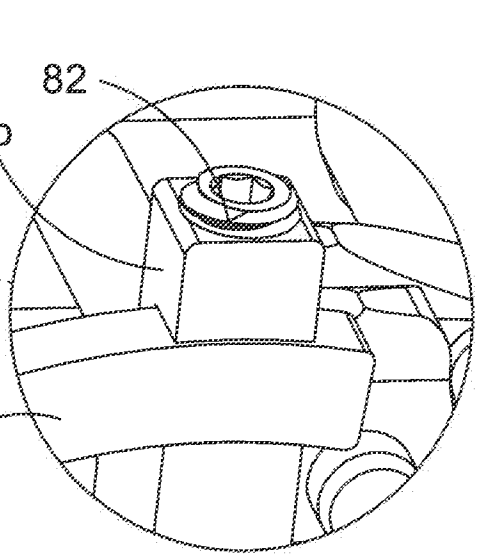
FIG. 10 is a detailed perspective view taken along line 10-10 of FIG. 9.
Figure 9:
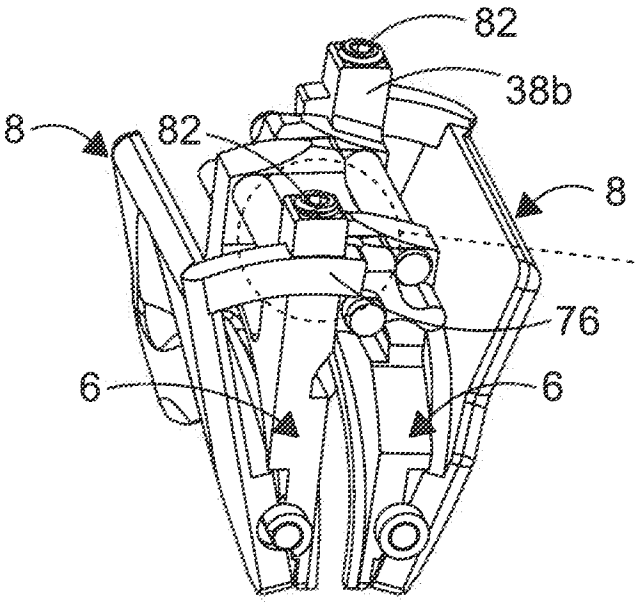
FIG. 9 is a bottom perspective view of the finger bed locking mechanism for the archery release of FIG. 1.
Figure 11B:
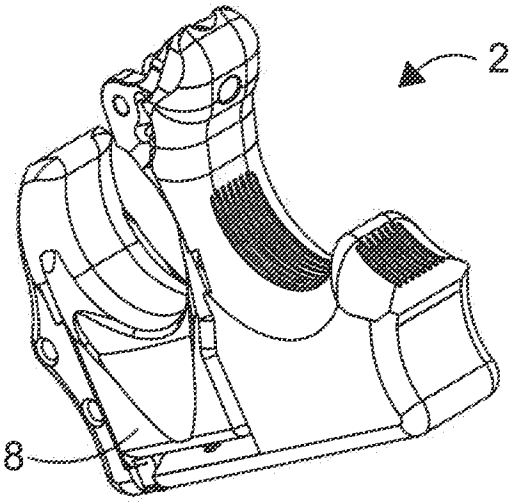
FIGS. 11*a*, 11*b*, 11*c*, and 11*d* are bottom rear left perspective, top rear left perspective, top perspective and bottom perspective views, respectively, of the archery release of FIG. 1 showing a narrow width and retracted condition of the finger beds.
Figure 11D:
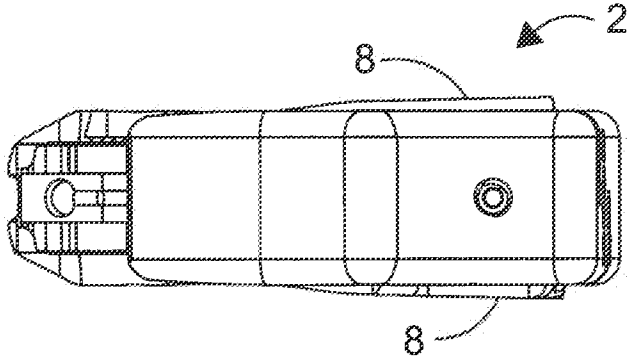
Figure 11A:
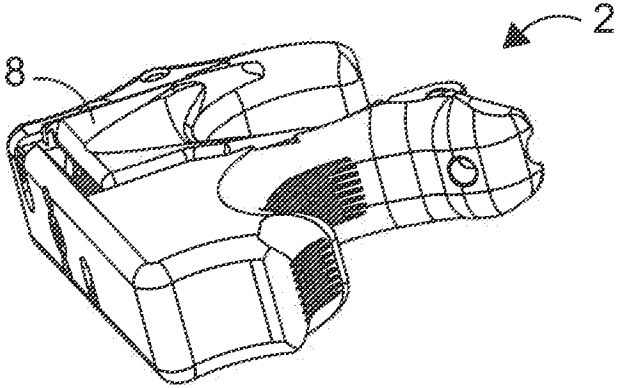
Figure 11C:
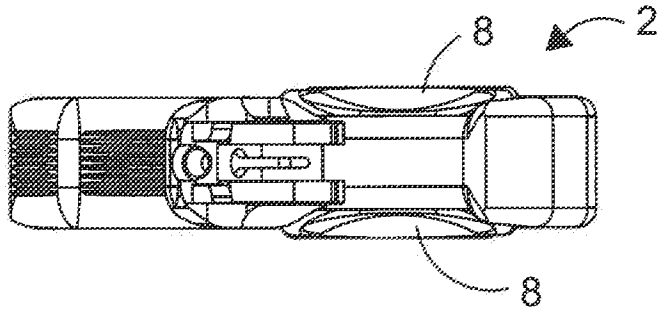
Figure 12B:
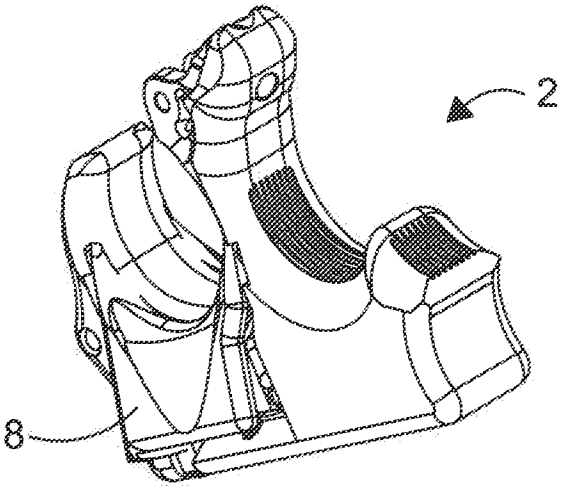
FIGS. 12*a*, 12*b*, 12*c*, and 12*d* are bottom rear left perspective, top rear left perspective, top perspective and bottom perspective views, respectively, of the archery release of FIG. 1 showing a narrow width and flared condition of the finger beds.
Figure 12D:
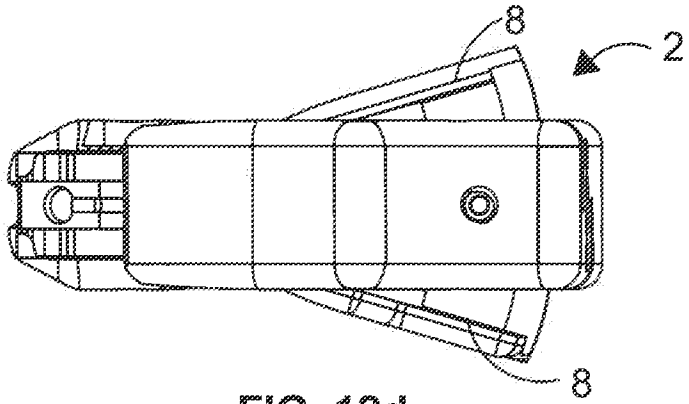
Figure 12A:
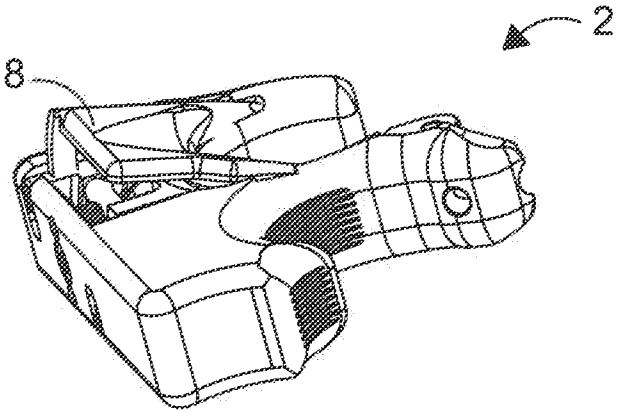
Figure 12C:
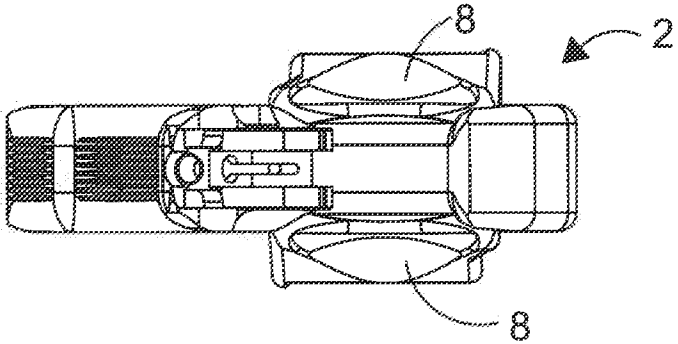
Figure 13B:
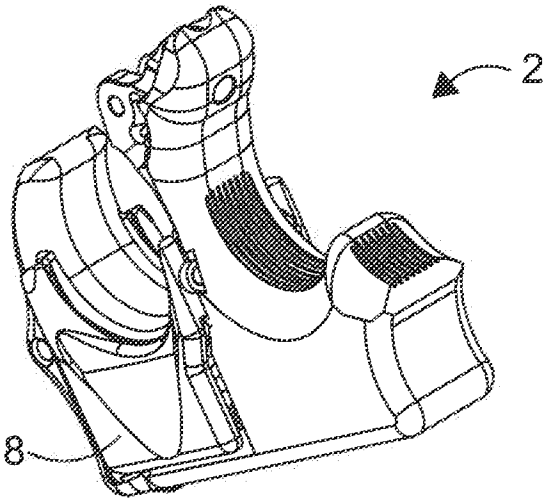
FIGS. 13*a*, 13*b*, 13*c*, and 13*d* are bottom rear left perspective, top rear left perspective, top perspective and bottom perspective views, respectively, of the archery release of FIG. 1 showing a wide width and retracted condition of the finger beds.
Figure 13D:
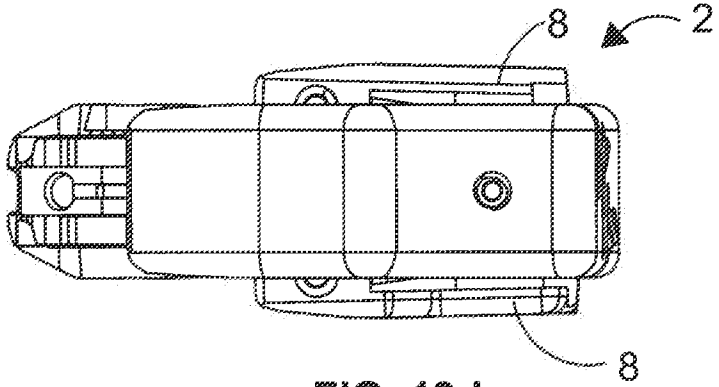
Figure 13A:
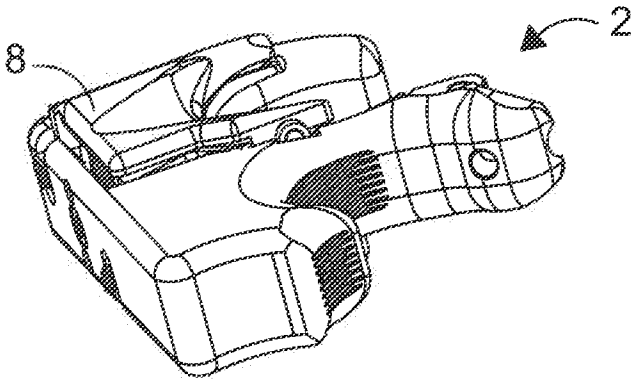
Figure 13C:
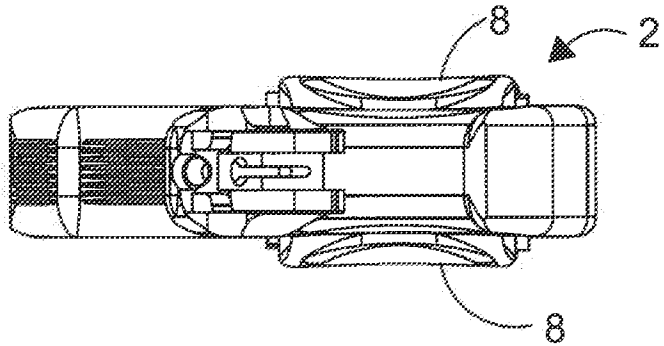
Figure 14B:
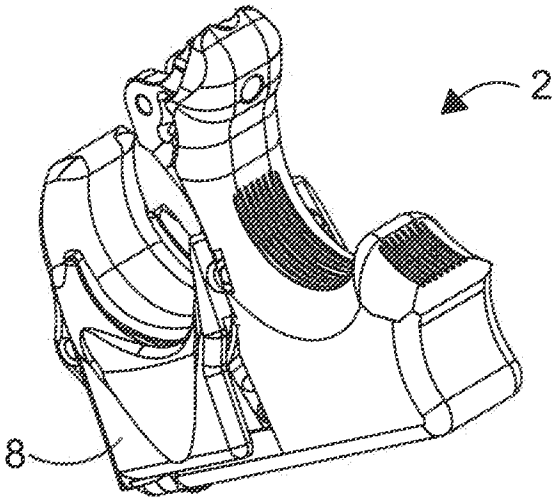
FIGS. 14*a*, 14*b*, 14*c*, and 14*d* are bottom rear left perspective, top rear left perspective, top perspective and bottom perspective views, respectively, of the archery release of FIG. 1 showing a wide width and flared condition of the finger beds.
Figure 14D:
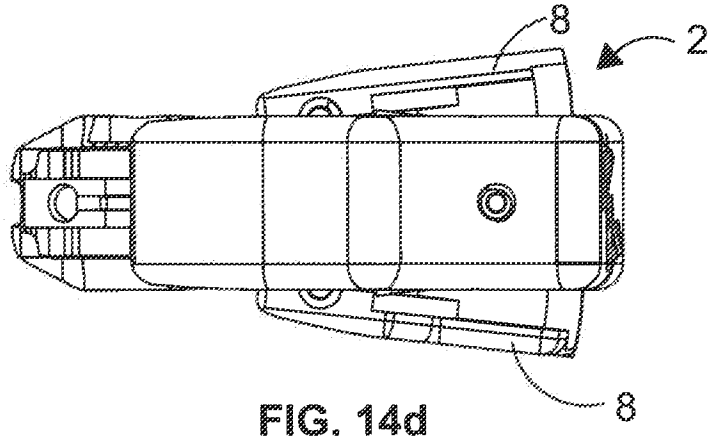
Figure 14A:
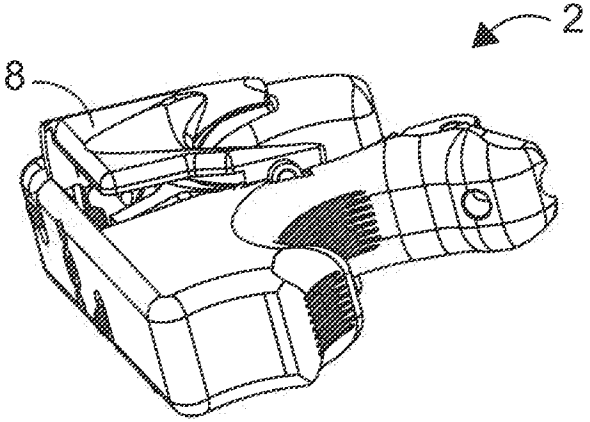
Figure 14C:
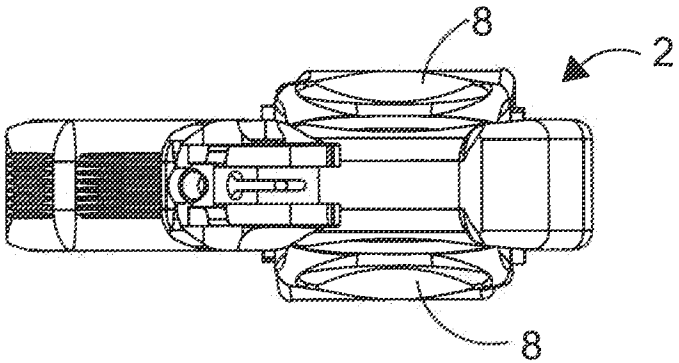

Referring to FIGS. 9 and 10, a preferred locking mechanism for the finger bed will be described. The bracket projection 38*b* contains a threaded opening 80 configured to receive a lock screw 82. The end of the screw within the projection is configured to engage the finger bed projection 76. When the screw is tightened, it presses against the finger bed projection and locks it in place relative to the bracket, thereby locking the finger bed in a selected angular position.

To adjust the angle of the finger bed, the archer loosens the screw 82 to release it from the finger bed projection. The archer then manually pivots the finger bed to a desired angle relative to the bracket. Once positioned, the screw is then tightened against the finger bed projection to lock the finger bed in position.

In accordance with the invention, an archery release is provided with finger supports which are adjustable in both width via operation of the width adjustment screw 56 to pivot the brackets relative to the handle and angle via release of the set screws 82 so that the archer can manually pivot the finger beds relative to the brackets.

FIGS. 11*a*-11*d* show the archery release 2 with the brackets and finger beds 8 in a narrow width position with the finger beds adjacent to the brackets.

FIGS. 12*a*-12*d* show the archery release 2 with the brackets and finger beds 8 in a narrow width position with the finger beds angled outwardly from the brackets.

FIGS. 13*a*-13*d* show the archery release 2 with the brackets and finger beds 8 in a wide width position with the finger beds adjacent to the handle sides.

FIGS. 14*a*-14*d* show the archery release 2 with the brackets and finger beds 8 in a wide width position with the finger beds angled outwardly from the brackets.

While the preferred forms and embodiments of the invention have been illustrated and described, it will become apparent to those of ordinary skill in the art that various changes and modifications may be made without deviating from the inventive concepts set forth above.

What is claimed is:

1. An adjustable finger support for an archery release, comprising (a) a handle having a longitudinal axis, top and bottom portions, and exterior side surfaces;

(b) a pair of finger beds configured for pivotal connection with said handle; and (c) a drive assembly connecting said finger beds with said handle and displacing said finger beds relative to said handle to a desired width to support a finger of an archer for operation of the archery release, whereby a head portion of the release may be positioned toward a target.

2. An adjustable finger support as defined in claim 1, wherein said drive assembly comprises a pair of brackets pivotally connected at a lower end with said handle, each finger bed being pivotally connected at its upper end with an upper end of each of said brackets, respectively.

3. An adjustable finger support as defined in claim 2, and further comprising a dowel pin arranged along said longitudinal axis which passes through aligned openings in said handle and said brackets to pivotally connect said brackets with said handle.

4. An adjustable finger support as defined in claim 3, wherein said drive assembly further comprises a toggle clamp arranged within said handle and having an elongated opening for receiving said dowel pin.

5. An adjustable finger support as defined in claim 4, wherein said drive assembly further comprises a width adjustment screw which passes through an opening in said handle and is threadably connected with a lower portion said toggle clamp to displace said toggle clamp relative to said handle in a direction normal to said longitudinal axis upon operation of said width adjustment screw.

6. An adjustable finger support as defined in claim 5, wherein said brackets each contain a tapered recess in an interior surface thereof, said brackets are arranged opposite each other within said housing, and said toggle clamp includes an upper portion having curved edges which extend into said tapered recesses of said brackets, respectively, said toggle clamp sliding within said tapered recesses during operation of said width adjustment screw to pivot said brackets about said dowel pin to adjust the width of said finger beds relative to said handle.

7. An adjustable finger support as defined in claim 6, and further comprising a pair of second dowel pins each being arranged between a bracket and said handle, respectively, and a pair of set screws connected with said handle on opposite sides of said width adjustment screw, one end of each set screw engaging a respective second dowel pin, whereby when said set screws are tightened against said second dowel pins, said brackets are retained in a selected width position and when said set screws are loosened from said second dowel pins, said width adjustment screw may be operated to adjust the width of said finger beds via said toggle clamp.

8. An adjustable finger support as defined in claim 4, wherein said handle comprises a pair of mating handle portions which define a cavity in which said toggle clamp is arranged.

9. An adjustable finger support as defined in claim 2, wherein each of said finger beds includes a projection extending from a lower end thereof toward a respective bracket.

10. An adjustable finger support as defined in claim 9, wherein each bracket includes a slot in a lower end thereof configured to receive said projection of a finger bed connected therewith.

11. An adjustable finger support as defined in claim 10, wherein each of said brackets includes a threaded opening communicating with said slot and a set screw arranged in said threaded opening, each set screw being operable to press against said projection to lock said finger bed in a selected angular position relative to said handle.

* * * * *